US007296305B2

(12) United States Patent
Ketterer et al.

(10) Patent No.: US 7,296,305 B2
(45) Date of Patent: Nov. 20, 2007

(54) ADJUSTABLE HEADBAND

(75) Inventors: Kevin R. Ketterer, Portersville, PA (US); Gregoire B. Aby-Eva, Pittsburgh, PA (US); F. Joseph Hersick, Zelienople, PA (US); Paul A. Zeller, Pittsburgh, PA (US); Anthony Scoccimerra, Jr., Ford City, PA (US); Robert E. Bechtold, East Pittsburgh, PA (US)

(73) Assignee: Mine Safety Appliances Company, Pittsburgh, PA (US)

( * ) Notice: Subject to any disclaimer, the term of this patent is extended or adjusted under 35 U.S.C. 154(b) by 308 days.

(21) Appl. No.: 11/045,788

(22) Filed: Jan. 28, 2005

(65) Prior Publication Data

US 2006/0101560 A1 May 18, 2006

Related U.S. Application Data

(60) Provisional application No. 60/627,635, filed on Nov. 12, 2004.

(51) Int. Cl.
*A42B 1/22* (2006.01)

(52) U.S. Cl. ..... 2/418; 24/579.09

(58) Field of Classification Search ..... 2/416, 2/417, 418, 183, DIG. 11; 24/615, 191, 16 PB, 24/17 AP, 30.5 P, 30.5 S, DIG. 48, 593.11, 24/579.11, 579.09
See application file for complete search history.

(56) References Cited

U.S. PATENT DOCUMENTS 2,979,794 A * 4/1961 De Bartolo ..... 24/17 R
3,430,306 A * 3/1969 Tareau ..... 24/593.1
3,500,474 A * 3/1970 Austin ..... 2/418
3,860,997 A * 1/1975 Van Riper et al. ..... 24/16 PB
4,727,630 A * 3/1988 Alan ..... 24/593.11
4,733,440 A * 3/1988 Ogawa ..... 24/170
4,942,628 A 7/1990 Freund
5,267,967 A * 12/1993 Schneider ..... 604/174
5,659,931 A * 8/1997 Anscher ..... 24/614
5,774,953 A * 7/1998 Mao ..... 24/579.09
5,890,497 A * 4/1999 Tsai ..... 132/273

(Continued)

FOREIGN PATENT DOCUMENTS

EP 1 074 195 2/2001

*Primary Examiner*—Katherine Moran
(74) *Attorney, Agent, or Firm*—James G. Uber; Henry E. Bartony, Jr.

(57) ABSTRACT

A headband for use in a headgear support includes a first end section having a plurality of spaced connectors and a second end section including a fastener attached adjacent the end thereof. The fastener includes a connecting member to which at least one cooperating connector is attached. The connecting member biases the cooperating connector in an engagement position with at least one of the plurality of connectors of the first end section to hold the headband in a selected loop configuration. The fastener further includes at least a first flexible release member. Upon application of a force to the first release member, the first flexible release member is movable to a release position (or range of positions) in which the first release member abuts the connecting member to cause the connecting member to flex to a disengage position (or range of positions) in which the cooperating connector is disengaged from the at least one the plurality of connectors of the first end section to enable increasing the size of the loop of the headband.

23 Claims, 9 Drawing Sheets

U.S. PATENT DOCUMENTS 5,896,586 A 4/1999 Freund
5,974,637 A * 11/1999 Tracy et al. ..... 24/633
6,170,133 B1 * 1/2001 Uehara ..... 24/614
6,219,851 B1 4/2001 Fang
6,219,889 B1 * 4/2001 Lovato et al. ..... 24/587.1
6,314,587 B1 11/2001 Fang
6,341,382 B1 1/2002 Ryvin
6,457,210 B1 * 10/2002 Shirai et al. ..... 24/16 PB
7,089,603 B2 * 8/2006 Ketterer et al. ..... 2/418
7,089,633 B2 * 8/2006 Liu ..... 24/615
2003/0106138 A1 6/2003 Guay
2005/0262618 A1 * 12/2005 Musal ..... 2/417

* cited by examiner 160
188b
178
188
170b
172
184b
178
170a
172
172
150
120
174a
180a
184a
188a
172
174a
174
190
130
122
125
122

Fig. 4B
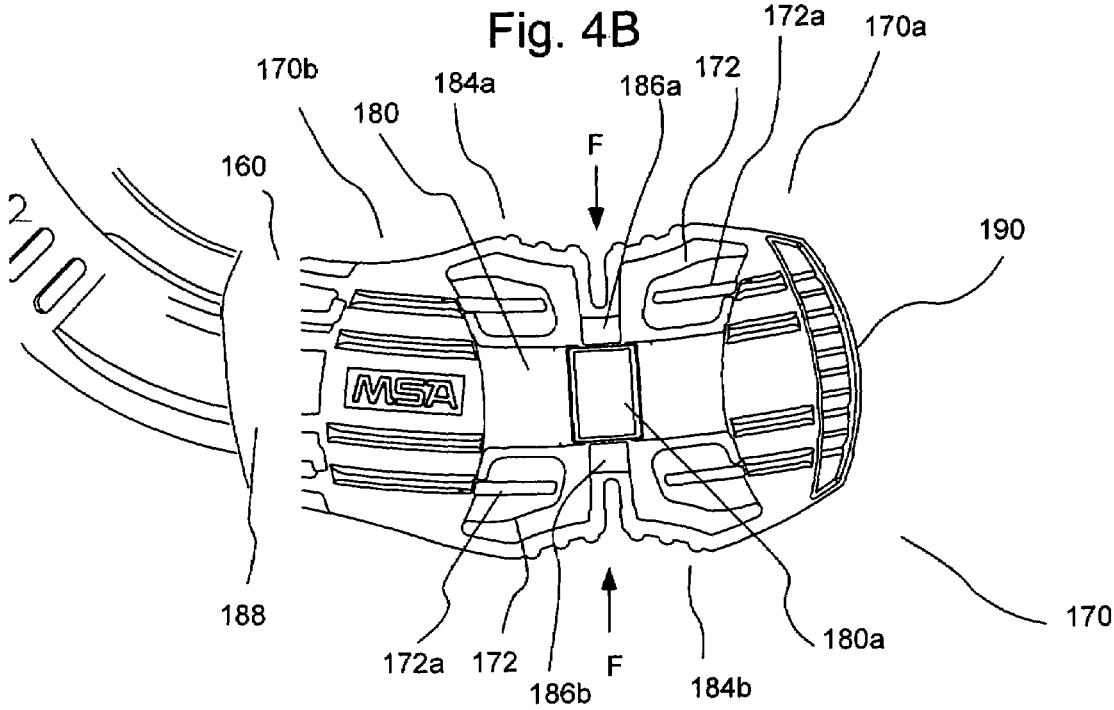
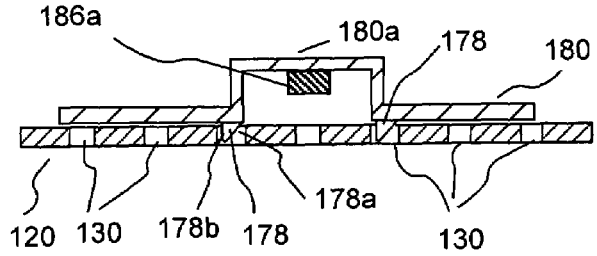
Fig. 4C
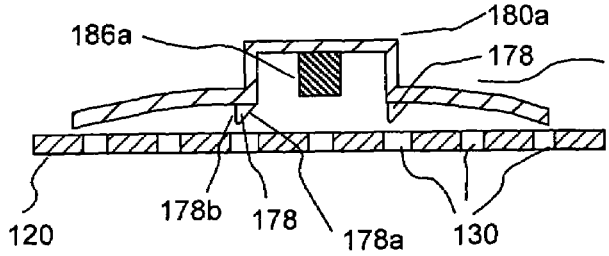
Fig. 4D 410
420
450
490
484
484a
470
434
428
460

450
490
484
470
484a
434
420
460

450
470
484
484a
420
434
460

ADJUSTABLE HEADBAND

CROSS-REFERENCE TO RELATED APPLICATION

This application claims benefit of U.S. Provisional Patent Application Ser. No. 60/627,635 filed Nov. 12, 2004, the disclosure of which is incorporated herein by reference.

FIELD OF THE INVENTION

The present invention relates generally to adjustable headbands and, particularly, to adjustable headbands for use in headgear, including, for example, personal protective products such as protective helmets, faceshields and welding shields.

BACKGROUND OF THE INVENTION

Most types of protective helmets worn by workers to protect them from falling objects have a suspension system. The suspension system or headgear support, along with the helmet shell, act to absorb the shock of a falling object striking the top of the worker's head. The suspension system also serves as a support that holds the helmet or faceshield on the worker's head.

The suspension is often a web-like support system comprising two or more strips of material that are arranged to cross each other. The ends of the strips are, for example, attached at four or more points around the circumference of the helmet. A headband is then typically attached to the four or more points of the suspension to permit the helmet to be worn by the worker. To securely position the helmet on the worker's head, it is essential that the circumference of the headband be adjustable to fit the appropriate head size. An adjustable napestrap is often attached at one end of the headband to achieve these results. Such a suspension system is available from Mine Safety Appliances Company of Pittsburgh, Pa. under the trademark STAZ-ON® and is described in U.S. Pat. No. 5,896,586.

U.S. Pat. No. 3,500,474, the disclosure of which is incorporated herein by reference, discloses a headband wherein the napestrap position of the headband is manually adjusted by the wearer to fit the appropriate head size. The two ends of the headband are connected and held in place by a slot-and-projection arrangement. One end of the headband is formed with parallel rows of projections or flanges. The other end of the headband is formed with parallel rows of slots. The size of the headband can be adjusted by inserting the projections of one end of the strap into the slots formed in the other end of the strap at the desired length. While this type of headband is relatively simple to manufacture (in part because separate mechanical fasteners or adjustment mechanisms are generally not required), users of such bands often have difficulty adjusting the band size while wearing the suspension. This inconvenience often results in the use of a different, more expensive type of suspension, such as a ratchet-type suspension system as, for example, described in U.S. Pat. No. 4,942,628.

U.S. Pat. No. 5,896,586, the disclosure of which is incorporated herein by reference, discloses a headband that is relatively simple to manufacture, while providing a fastening mechanism that is relatively easy to adjust. This headband can be fabricated from an integral or monolithic piece of polymeric material. The headband includes a first end and a second end which overlap. The first end includes a plurality of longitudinally spaced attachment members (for example, depressions, recesses or slots). The second end includes a resilient fastener having an opening or a channel to slidably receive the first end in overlapping engagement with the second end. The fastener also includes a fastener surface having at least one cooperating attachment member to cooperate with the attachment members of the first end of the band. The fastener surface is resiliently bowable in a direction away from the first end upon application of a compressive force to the fastener. Upon application of such compressive force, the attachment member of the first end of the band and the cooperating attachment member of the fastener disconnect so that the first end can be slid relative to the fastener (and thereby the second end). Unfortunately, it can be difficult to operate the bowable fastening mechanism of U.S. Pat. No. 5,896,586 with only one hand.

U.S. Pat. No. 6,341,382 also discloses a one-piece adjustable headband which is constructed of lightweight material such as a plastic. The strap is constructed with an integral adjustment or fastening mechanism to adjust the fit of the strap around the head of wearer, purportedly using a single hand. The headband includes a first end, a second end, an interior surface, and an exterior surface. A plurality of ratchet teeth extend from the exterior surface of the headband adjacent the first end thereof. Each of the ratchet teeth has a tapered surface and a locking surface. A clasp is resiliently connected to the exterior surface of the headband adjacent the second end thereof. The clasp includes a pawl which is biased in a locking position wherein the pawl is engageable with the locking surface of one of the ratchet teeth to hold the headband in a selected loop configuration. The clasp is movable to a release position upon application of a force generally normal to the plane of the headband whereby the pawl is moved away from the ratchet teeth to permit the loop configuration of the headband to be increased in size.

Although a number of fastening or adjusting mechanisms have been developed for headbands or head straps for use in headgear, and especially in personal protective equipment such as protective helmets, faceshields and welding shields having a headgear support, it remains desirable to develop improved headbands and adjusting mechanism for use therein, and preferably ones which can be adjusted using only one hand, and more preferably which can also be adjusted with one hand while a user is wearing the protective headgear support.

SUMMARY OF THE INVENTION

In one aspect, the present invention provides a headband for use in a headgear support including a first end section having a plurality of spaced connectors and a second end section including a fastener attached adjacent the end thereof. The fastener includes a connecting member to which at least one cooperating connector is attached. The connecting member biases the cooperating connector in an engagement position with at least one of the plurality of connectors of the first end section to hold the headband in a selected loop configuration. The fastener further includes at least a first flexible release member. Upon application of a force to the first release member, the first flexible release member is movable to a release position (or range of positions) in which the first release member abuts the connecting member to cause the connecting member to flex to a disengage position (or range of positions) in which the cooperating connector is disengaged from the at least one of the plurality of connectors of the first end section to enable increasing the size of the loop of the headband.

In one embodiment, the plurality of connectors on the first end section are slots. The at least one cooperating connector can, for example, be a projection. More than one projection can attached to the connecting member. In another embodiment, each of the projections includes a first surface which is angled to facilitate sliding of the projections over the slots of the first end section when the first end section and the second end section are moved relative to each other to decrease the size of the loop of the headband. In this embodiment, each of the projections also includes a second surface that is angled to abut one of the slots of the first end section when in the engagement position and to provide resistance to movement of first end section and second end section relative to each other in a direction to increase the size of the loop of the headband when in the engagement position.

A generally lateral force can, for example, be applied to the first release member to place the first release member in the release position. The first release member can, for example, include a sloped surface which abuts the connecting member. The headband can further include a second release member that is movable to a release position upon application of a force to the second release member in which the second release member abuts the connecting member to cause the connecting member to flex to the disengage position. In one embodiment, the first release member is positioned on one lateral side of the fastener, and the second release member is positioned on the other side of the fastener.

In another aspect, the present invention provides a headband for use in a headgear support including a first end section having a plurality of spaced slots and a second end section including a fastener attached adjacent the end thereof. The fastener includes a flexible connecting member and at least one cooperating connector attached to the connecting member and biased by the connecting member in an engagement position with at least one of the plurality of slots of the first end section to hold the headband in a selected loop configuration. The connecting member is movable to a disengage position upon application of a generally lateral force to the fastener to cause the cooperating connector to disengage from the at least one of the plurality of slots of the first end section to enable increasing the size of the loop of the headband.

The at least one cooperating connector can, for example, be a projection. As described above, the projection can include a first surface which is angled to facilitate sliding of the projections over the slots of the first end section when the first end section and the second end section are moved relative to each other to decrease the size of the loop of the headband. In this embodiment, the projection can further include a second surface that is angled to abut one of the slots of the first end section when in the engagement position and to provide resistance to movement of first end section and second end section relative to each other in a direction to increase the size of the loop of the headband when in the engagement position.

The headband can further include at least a first flexible release member which is movable to a release position upon application of a generally lateral force thereto. In the release position, the first release member abuts the connecting member to cause the connecting member to flex to the disengage position. In one embodiment, the headband further includes a second release member which is movable to a release position upon application of a generally lateral force to the second release member. In the release position thereof, the second release member abuts the connecting member to cause the connecting member to flex to the disengage position. The first release member can, for example, be positioned on one lateral side of the fastener, and the second release member can be positioned on the other side of the fastener.

In one embodiment, a generally lateral force is applied directly to the connecting member to cause the connecting member to move to the disengage position.

In still a further aspect, the present invention provides a headband for use in a headgear support including a first end section having a plurality of spaced slots and a second end section including a fastener attached adjacent the end thereof. The fastener includes a flexible connecting member and at least one projection attached to the connecting member and biased by the connecting member in an engagement position with one of the plurality of slots of the first end section to define a selected loop configuration of the headband. The fastener further including a first flexible release member on a first lateral side of the fastener. The first flexible release member is movable to a release position upon application of a force to the first release member. In the release position thereof, the first release member abuts the connecting member to cause the connecting member to flex to a disengage position in which the projection is disengaged from the at least one the plurality of connectors of the first end section to enable increasing the size of the loop of the headband., The fastener also includes a second flexible release member on a second lateral side of the fastener. The second flexible release member is movable to a release position upon application of a force to the second release member. In the release position thereof, the second release member abuts the connecting member to cause the connecting member to flex to the disengage position. Each of the first release member and the second release member can, for example, include a sloped surface to abut the connecting member.

BRIEF DESCRIPTION OF THE DRAWINGS

FIG. 4B illustrates an enlarged view of the fastener in the orientation of FIG. 4A.

FIG. 4C illustrates a cross-sectional view of the connecting member of the fastener in a connecting or a locking state wherein the projections or flanges of the connecting member are in operative connection with the slots of the first end section.

FIG. 4D illustrates a cross-sectional view of the connecting member of the fastener in a stressed or release state wherein the projections or flanges of the connecting member are raised out of operative connection with the slots of the first end section.

DETAILED DESCRIPTION OF THE INVENTION

Figures 1, 2C:
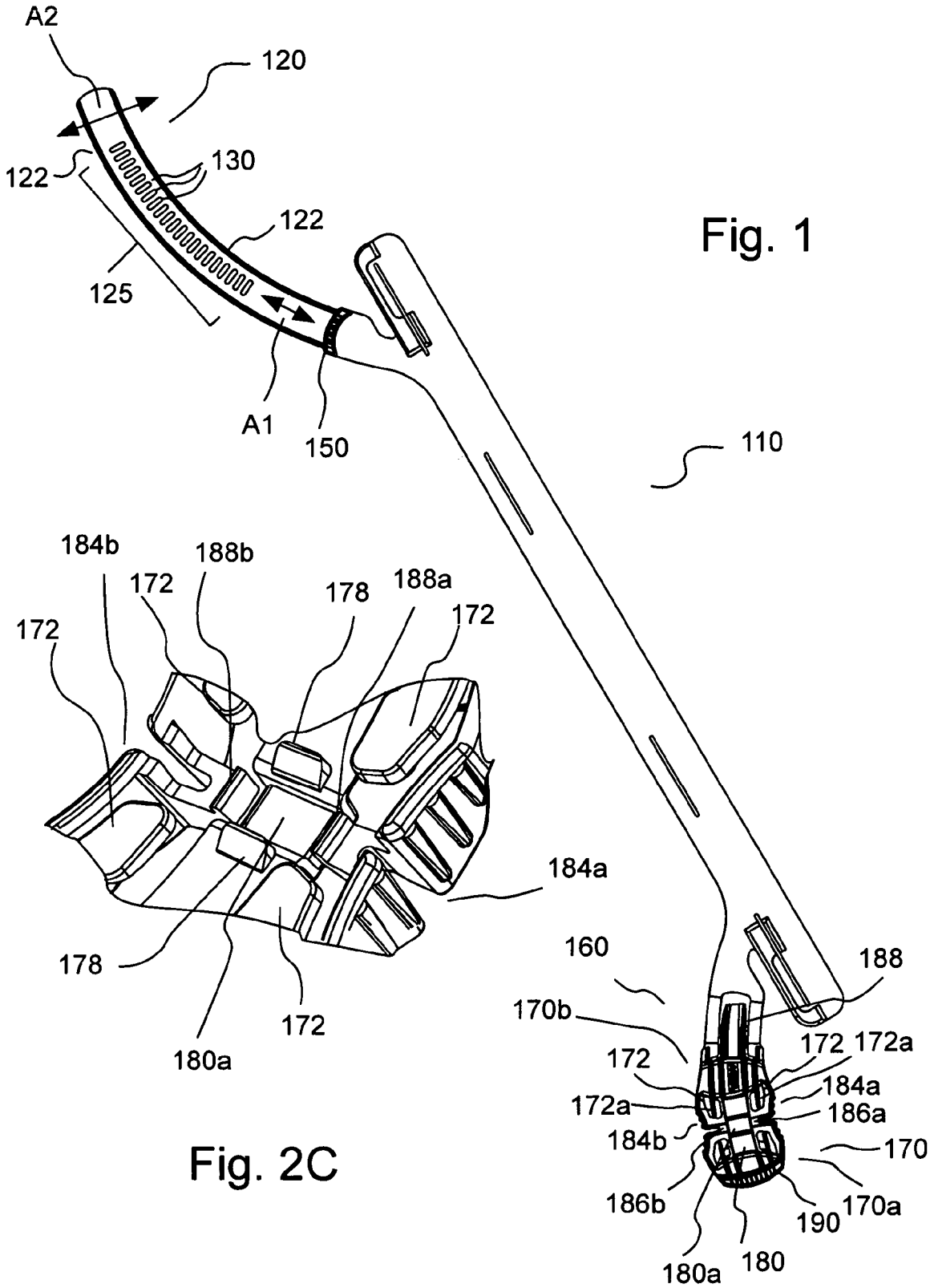
FIG. 1 illustrates a perspective view of an embodiment of a headband of the present invention having a first end section and a second end section thereof in a disconnected state.
FIG. 2C is an enlarged perspective view of a portion of the fastener of the second end section.
Figures 2A, 2B:
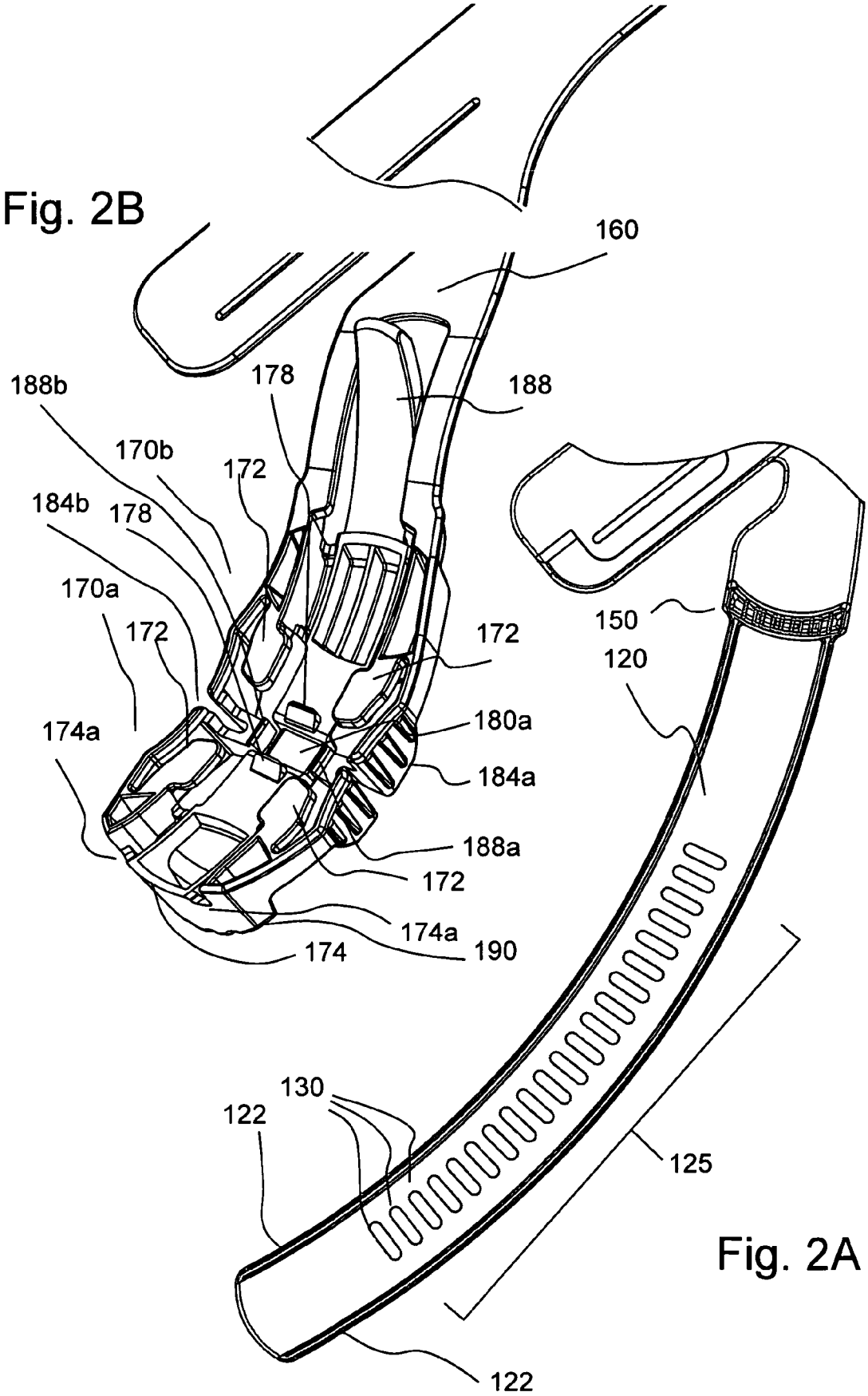
FIG. 2A illustrates an enlarged perspective view of the first end section of FIG. 1.
FIG. 2B illustrates an enlarged perspective view of the second end section of FIG. 1.
Figures 3A, 3B:
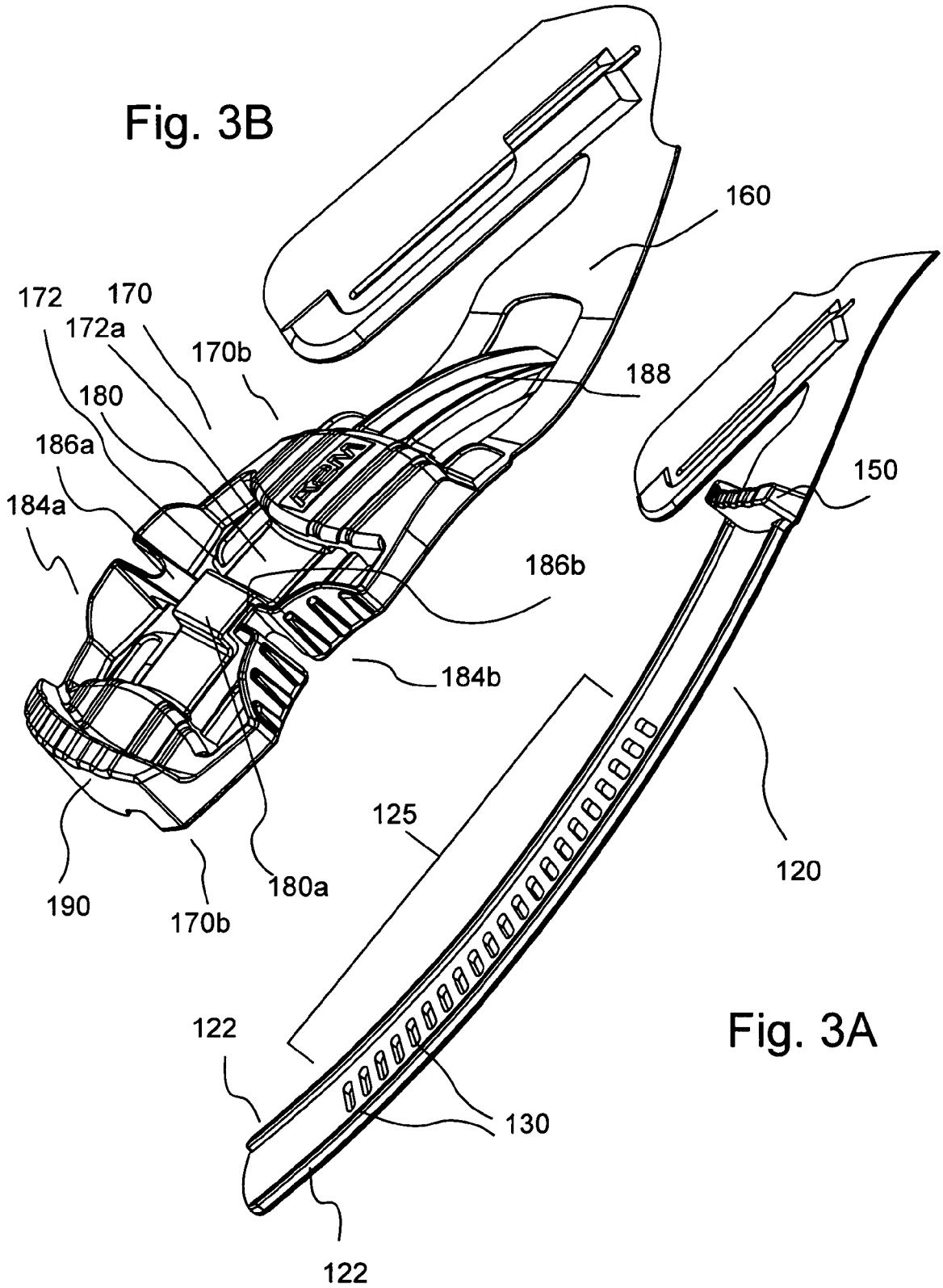
FIG. 3A illustrates another perspective view of the first end section of FIG. 1.
FIG. 3B illustrates another perspective view of the second end section of FIG. 1.
Figure 5:
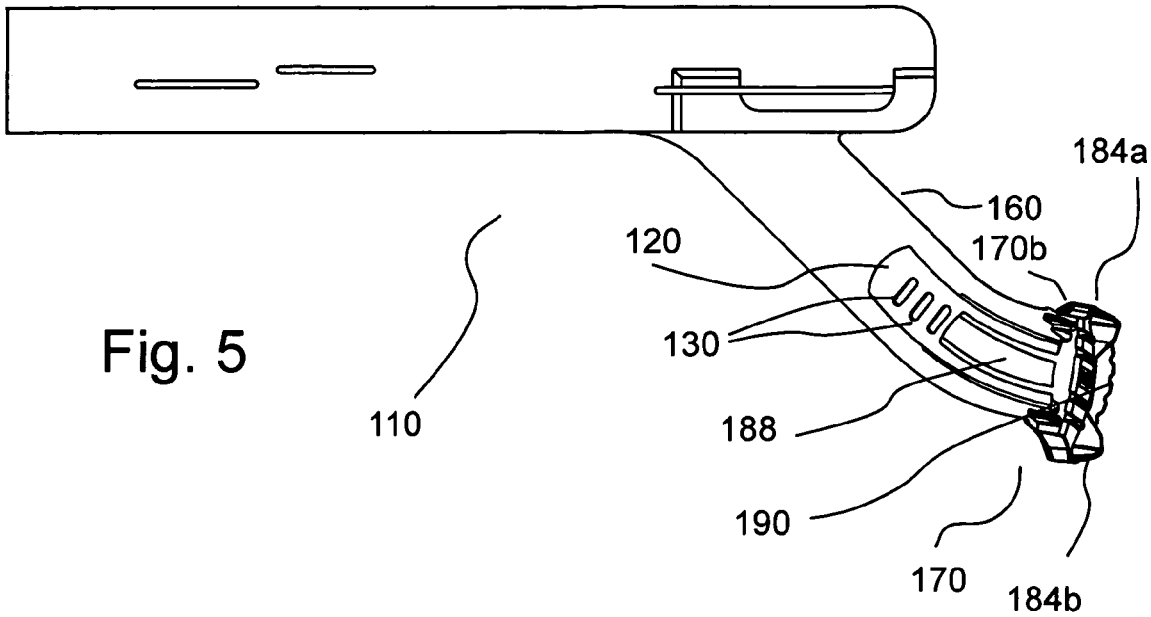
FIG. 5 illustrates a perspective view of the headband of FIG. 1 with the first end section and the second end section in a connected state wherein the headband is rotated approximately 90° from the view of FIG. 4A.

FIG. 1 illustrates an embodiment of a headband or head strap 110 of the present invention for use in a headgear support. Headband 110 is, for example, a flexible member that can be molded from one or more suitable polymeric materials to extend around the head of the user. Headband 110 can, for example, be formed from an integral or monolithic piece of polymeric material or can, for example, be co-molded or otherwise fabricated from two or more polymeric materials. A first end 120 and second end 160 overlap, preferably at the back of the wearer's head (see, for example, FIGS. 4A and 4B). Headband 110 may be straight from end to end, in which case first end 120 and second end 160 will overlap on the head of the user. On the other hand, first end 120 and second end 160 may extend downwardly in the rear portion of headband 110 across the nape of the neck. The latter embodiment is illustrated in FIGS. 1 through 5. Regardless of which type of headband 110 is used, overlapping ends 120 and 160 are connected in the same manner.

First end 120 includes a connection mechanism 125 that, in the embodiment of FIGS. 1 through 5, comprises a plurality of longitudinally spaced connective elements such as spaced slots 130. Second end 160 includes a cooperating fastener 170 which includes at least one cooperating connective element that forms an operative connection with at least one of the spaced connective elements of connection mechanism 125 to form an adjustable overlapping connection between first end 120 and second end 160. In FIG. 1, arrow A1 represents a generally latitudinal direction as such term is used herein, whereas arrow A2 represents a generally longitudinal direction as such term is used herein.

First end 120 is maintained in slidable connection with fastener 170 and second end 160 via retaining members 172 (see, for example, FIG. 4B) on an interior side thereof (that is, the side closest to the wearer's head while donned) of fastener 170. Each of retaining member 172 also includes a projecting flange or ridge 172*a* which abuts the sides of first end section 120 when first end section 120 is in operative connection with second end section 160. First end section 120 passes through an opening or notch 174 formed in fastener 170. Retaining members 172 and opening 174 form a channel through which first end section 120 is slidable to adjust the loop formed by headband 110 (see, for example, FIGS. 4A and 5 for an example of the loop configuration). Opening 174 includes recesses 174*a* through which ridges 122 formed on the lateral sides of first end section 120 pass. Ridges 122 can, for example, add strength or stiffness to first end section 120.

Fastener 170, for example, includes a flexible connecting member or arm 180 having at least one cooperating abutment member or tooth 178 (see, for example, FIGS. 2B and 4C) attached thereto. Each of abutment members 178 extends into one of slots 130 (see, for example, FIG. 4C) to form an operative connection between first end section 120 and second end section 160.

In the embodiment of FIGS. 1 through 5, abutment members 178 are in the form of projections or flanges and include a first surface 178*a* (see FIGS. 4C and 4D) that is sloped to facilitate sliding of first end 120 through fastener 170 to reduce the size of headband 110 (thereby tightening the fit thereof). For example, application of an appropriate force to first end 120 (and/or second end 160) to tighten headband 110 causes sloped surfaces 178*a* of projections 178 to "slide over" or past slots 130. Projections 178 further include a second surface 178*b* (see FIGS. 4C and 4D) that is generally vertical. Surfaces 178*b*, in cooperative connection with slots 130, provide substantial resistance to movement of first end 120 away from second end 160 (which would result in loosening of the fit of headband 110). In that regard, loosening of the fit of headband 170 typically requires placement of flexible connecting member 180 into a release or bowed state as illustrated in FIG. 4D to move projections 178 out of operative abutting connection with slots 130.

In the embodiment of FIGS. 1 through 5, fastener 170 includes a first end 170*a* and a second end 170*b*. Connecting member 180 is attached at a first end thereof to first end 170*a* of fastener 170 and at a second end thereof to second end 170*b* of fastener 170. Flexible connecting member 180 includes a raised section 180*a* generally in the center thereof. Fastener 170 further includes first and second (or upper and lower, in the orientation of, for example, FIG. 4A) flexible release members 184*a* and 184*b*, respectively, on each lateral side thereof. First and second flexible release members 184*a* and 184*b* are attached at a first end thereof to first end 170*a* of fastener 170 and at a second end thereof to second end 170*b* of fastener 170 and can flex about those points of attachment.

To place connecting member 180 in its bowed or release position or state as illustrated in FIG. 4D, the wearer of headband 110 reaches behind the wearer's head and applies (for example, with a single hand) a generally latitudinal compressing force F (see FIG. 4B) to each of flexible release member 184*a* and 184*b*. For example, the wearer can place the wearer's thumb on lower release member 184*a* and the wearer's index finger on the upper release member 184*b* and squeeze upper and lower release member 184*a* and 184*b* toward each other. Each of flexible release members 184*a* and 184*b* includes a sloped abutment member 186*a* and 186*b* (see, for example, FIGS. 3B and 4B), respectively, in operative connection therewith. As release members 184*a* and 184*b*, and thereby sloped abutment members 186*a* and 186*b*, are forced toward each other, abutment of sloped abutment members 186*a* and 186*b* with raised section 180*a* of connecting member 180 forces connecting member 180 into its release state as illustrated in FIG. 4D. As abutment members 186*a* and 186*b* are forced toward each other, inward projecting contact members 188*a* and 188*b* on an inner side of abutment members 186*a* and 186*b* contact and slide along the outer surface of first section 120, thereby reducing or eliminating bending of abutment member 186*a* and 186*b* relative to connecting member 180. Rearward motion of first section 120 relative to fastener 170 and connecting member 180 is prevented by contact of the inner surface of first section 120 with retaining members 172. In the release state or position of connecting member 180, projections 178 are out of contact with slots 130, and first section 120 can be moved relative to second section 160 and fastener 170. When compressive force as described above is removed from release members 184*a* and 184*b*, release members 184*a* and 184*b* (and abutment members 186*a* and 186*b*) return to their unstressed or locking state as illustrated in FIGS. 4B and 4C, allowing connecting member 180 to return to its locking or connecting state as illustrated in FIG. 4C. Even in its locking state, connecting member 180 can be flexed and not fully relaxed so that it biases projections 178 in operative connection with slots 130 of first end 120.

Actuation of release members 184*a* and 184*b* is typically required only to loosen or enlarge headband 110. In that regard, projections 178 provide little resistance to motion of first end section 110 relative to second end section 160 and fastener 170 in a tightening direction. To tighten the fit of headband 110, the user can readily reach behind his or her head, place the user's fingers in contact with tab 150 on first end 120 and with tab 190 on fastener 170, and force tabs 150 and 190 toward each other to tighten the fit of headband 110.

Figure 4A:
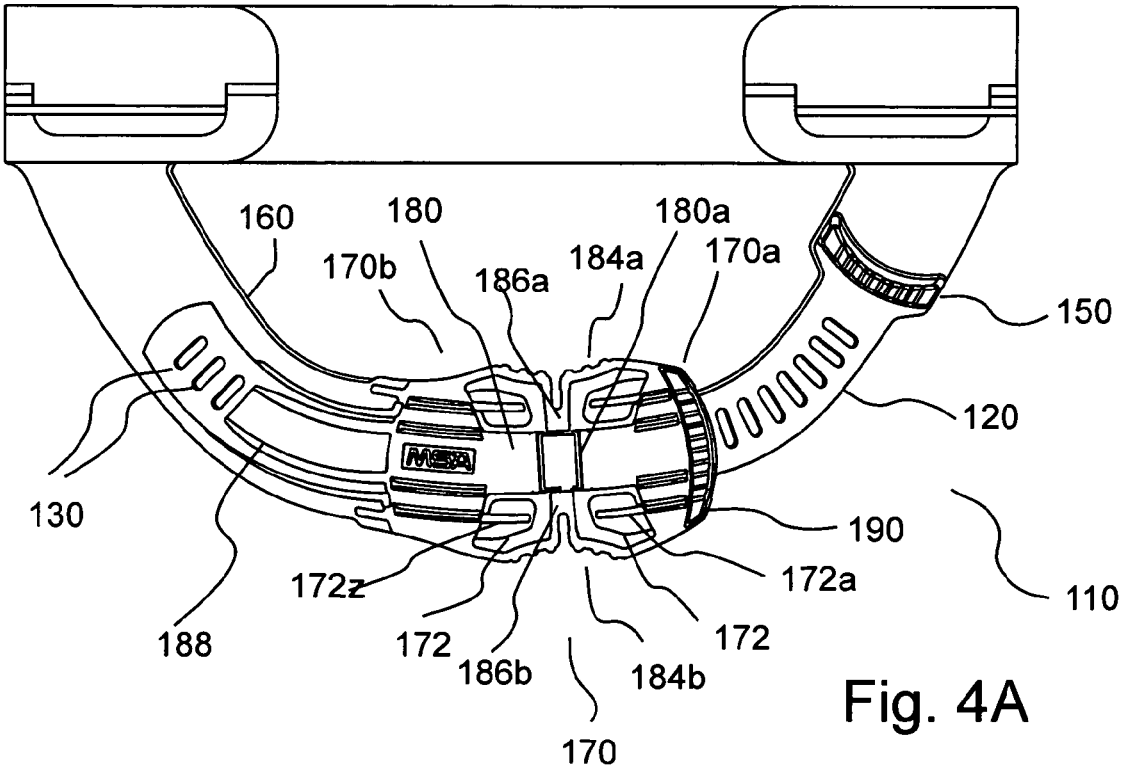
FIG. 4A illustrates a perspective view of the headband of FIG. 1 with the first end section and the second end section in a connected state.

As illustrated, for example, in FIG. 4A, second end section 160 also includes an extending member 188 extending from second end 170*b* of fastener 170. Extending member 188 contacts first end section 120 and assists in maintaining that portion of first end section 120 that projects through fastener 170 in close proximity to second end section 160.

As described above, all components of fastener 170 can, for example, be fabricated as a monolithic unit (via, for example, molding) from a resilient polymeric material wherein connecting member 180 flexes about its attachment points with first end 170*a* and second end 170*b* of fastener 170 and release member 184*a* and 184*b* flex about their attachment points with first end 170*a* and second end 170*b* of fastener 170. Likewise the entirety of headband 110 can be fabricated as a monolithic unit from a resilient polymeric material. Alternatively, one or more components of headband 110 can be fabricated from different materials via, for example, a co-molding process as known in the art. One or more components of headband 110 can alternatively be fabricated separately and later assembled to form headband 110. Resilient polymeric materials suitable for use in the present invention include, but are not limited to, polypropylene, high density polyethylene and/or nylon.

FIGS. 6A through 6E illustrate another embodiment of a headband 310 of the present invention. Like headband 110, headband 310 includes a first end section 320 and a second end section 360. First end section 320 includes a plurality of slots 334 formed in an upper or outer surface 328 thereof. Second end section 360 includes a fastener 370. Fastener 370 includes tabs or flanges 372 (see FIG. 6E) on a rearward side thereof and an opening 372*a* through which first end 320 passes to assist in maintaining first end 320 in operative connection with fastener 370 and first end 360. Fastener 370 includes a cantilevered connecting member or arm 384 including a downward oriented abutment member such as a projection 386 on an end thereof. Projection 386 operatively cooperates with slots 334 to adjust the fit of headband 310. Projection 386 can, for example, include a sloped surface 386*a* proximal to or facing first end 320 (which causes little resistance to tightening of headband 310) and a generally vertical surface 386*b* (which provides substantial resistance to loosening of headband 310).

Figure 6B:
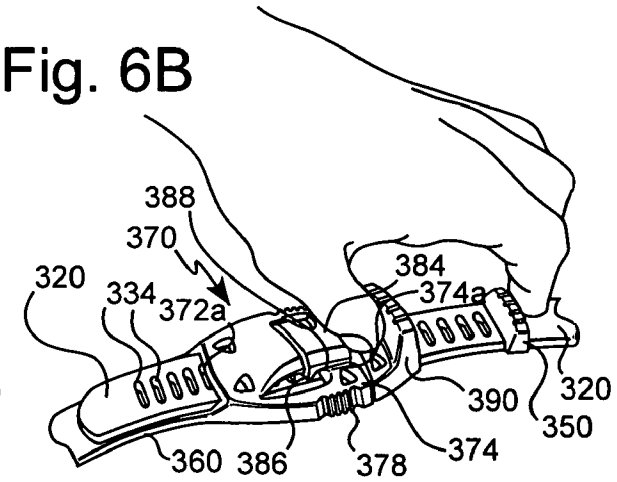
FIG. 6B illustrates tightening of the fit the headband of FIG. 6A.
Figure 6C:
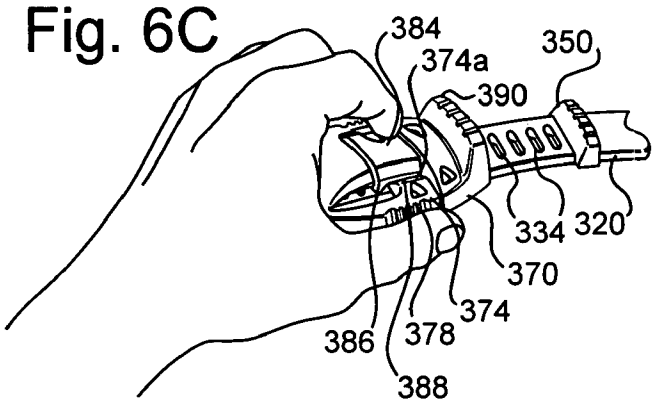
FIG. 6C illustrates application of-force to a release member in the form of a lever arm of the fastener of the headband of FIG. 6A to loosen the fit of the headband.
Figure 6A:
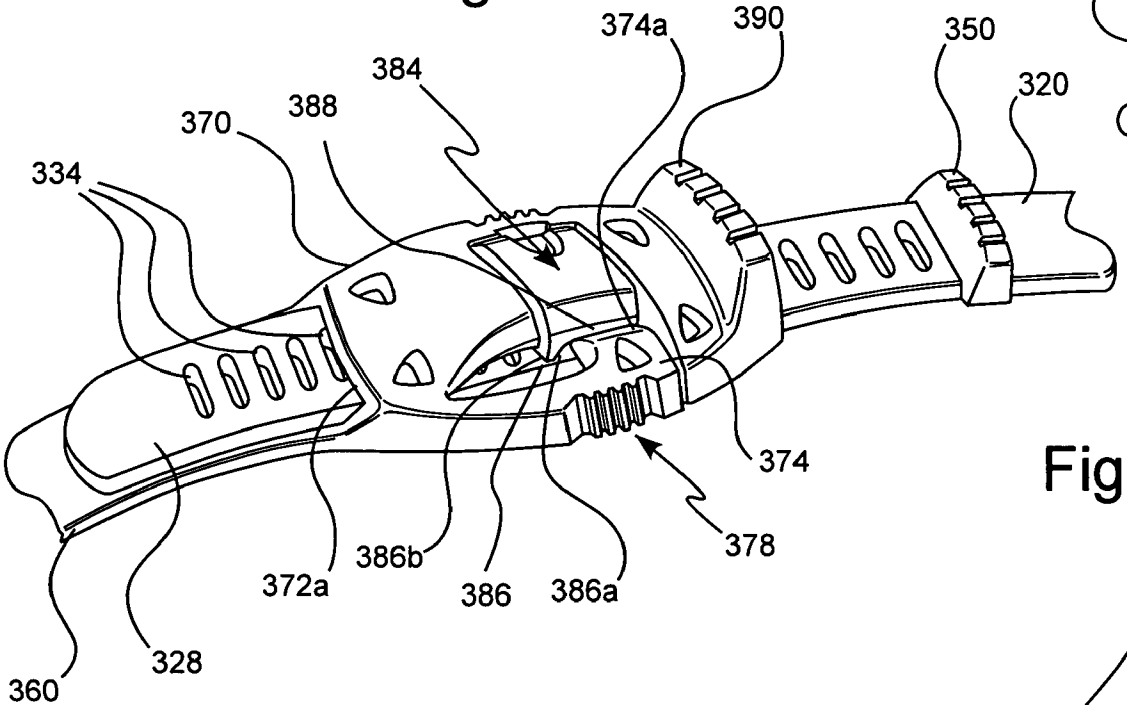
FIG. 6A illustrates a front perspective view of another embodiment of a headband of the present invention with the first end section and the second end section connected.
Figure 6D:
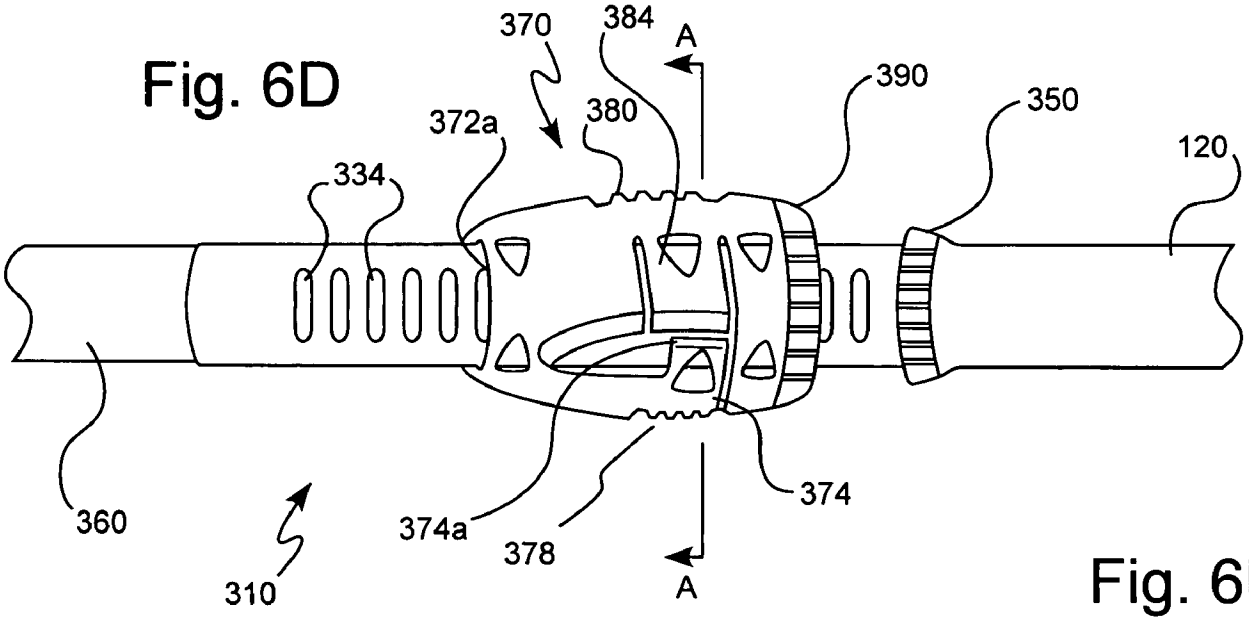
FIG. 6D illustrates a front plan view of the headband of FIG. 6A.
Figure 6E:
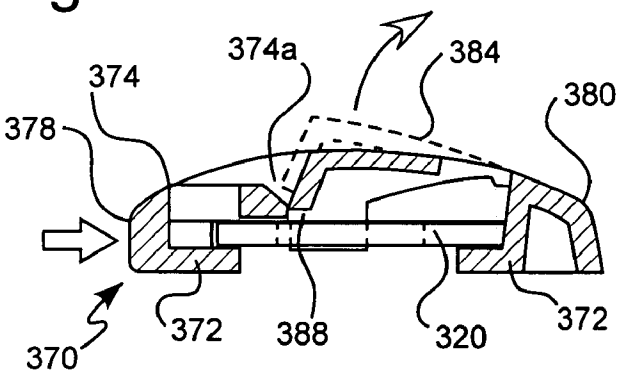
FIG. 6E illustrates a cross-sectional view of the headband of FIG. 6A.

Fastener 370 further includes a single release member in the form of a lever arm 374 including a beveled or sloped surface 374*a* which is adapted to contact a lower edge 388 of flexible connecting member 384. Application of force to finger contact 378 of release member 374 (as illustrated in FIGS. 6C and 6E) causes release member 374 to move or flex latitudinally upward (in the orientation of FIG. 6D). Sloped surface 374*a* of release member 374 forces cantilevered connecting member 384 to swing outward, away from first end 320, thereby removing projection 386 from operative connection with slots 334 (see, for example, FIG. 6E). A finger contact 380 (see FIG. 6C) opposite to finger contact 378 can be provided to facilitate operation of release member 374. Tabs 350 and 390 can be used in the manner described above in connection with tabs 150 and 190 of headband 110 to facilitate tightening of headband 310. Use of tabs 350 and 390 to tighten headband 310 is illustrated in FIG. 6B.

Figures 7A, 7B, 7C:
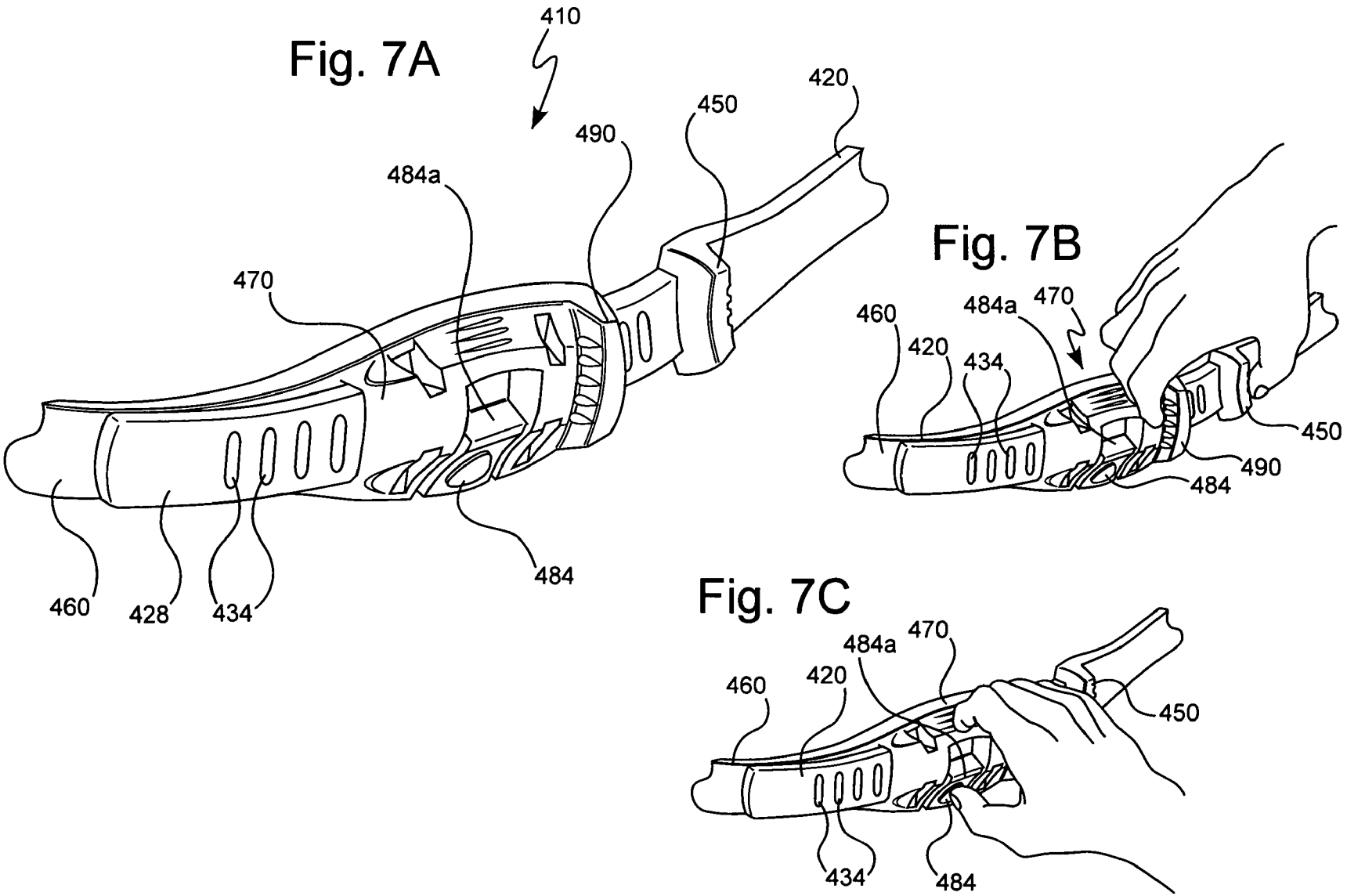
FIG. 7A illustrates a front perspective view of another embodiment of a headband of the present invention with the first end section and the second end section connected.
FIG. 7B illustrates tightening of the fit the headband of FIG. 7A.
FIG. 7C illustrates application of force to a connecting member of the fastener of the headband of FIG. 7A to loosen the fit of the headband.
Figure 7D:
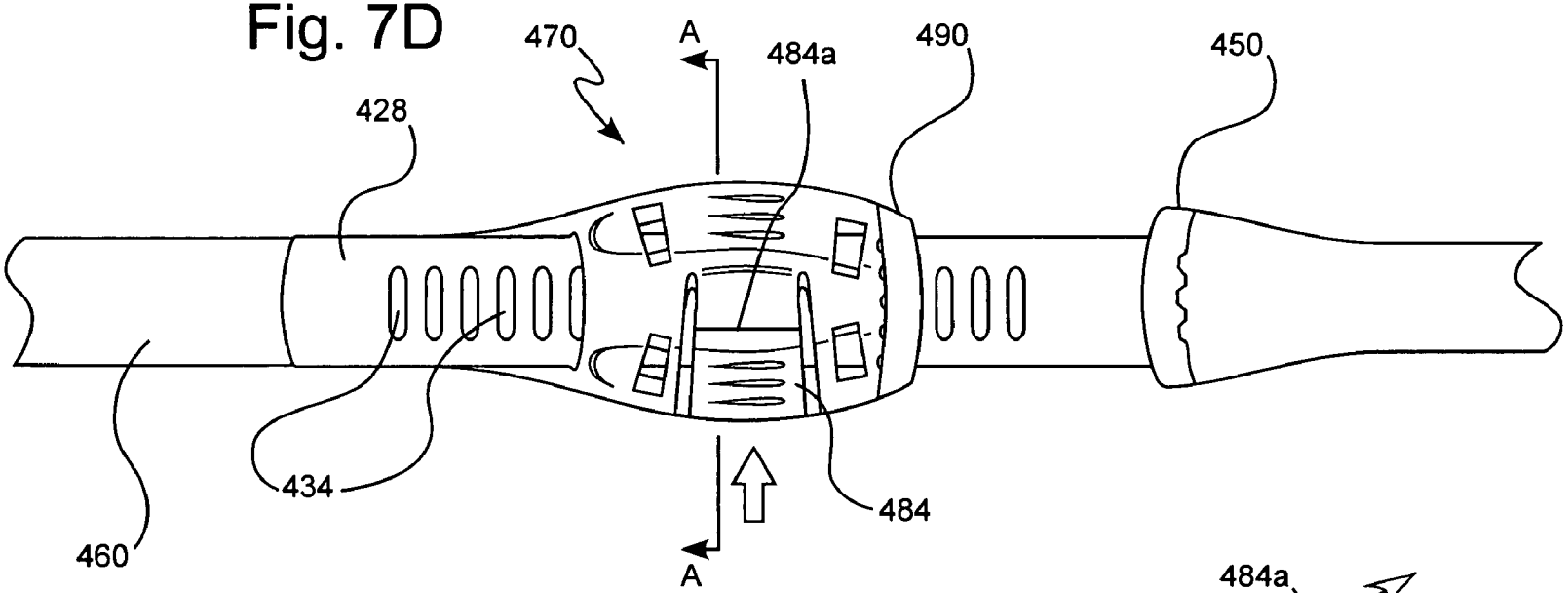
FIG. 7D illustrates a front plan view of the headband of FIG. 7A.
Figure 7E:
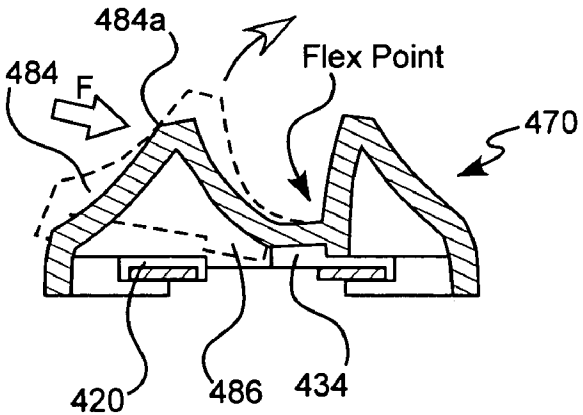
FIG. 7E illustrates a cross-sectional view of the headband of FIG. 7A.

FIGS. 7A through 7E illustrate another embodiment of a headband 410 of the present invention in which a first end 420 includes a plurality of slots 434 formed in an outer surface thereof. Second end 460 includes a fastener 470 In this embodiment, fastener 470 includes a flexible connecting member in the form of a lever arm 484 including an abutment member such as a projection 486 which forms an operative connection with one of slots 434 to control the fit of headband 410. In the embodiment of FIGS. 7A through 7E, force is applied by the wearer directly to an outward projecting flange or tab 484*a* of connecting member 484 to place release member 484 in a release state. In that regard, a generally lateral force can be applied to release member 484 as illustrated in FIGS. 7C and 7E to cause release member 484 to swing outward as illustrated in FIG. 7E to remove projection 486 from operative connection with slots 434 to enable loosening of headband 410. Projection 486 can, for example, include a sloped surface and a generally vertical surface as described above to provide little resistance to tightening the fit of headband 410 while providing substantial resistance to loosening of the fit of headband 410. Tabs 450 and 490 can be used in the manner described above to facilitate tightening of headband 410 as illustrated in FIG. 7B.

The foregoing description and accompanying drawings set forth preferred embodiments of the invention at the present time. Various modifications, additions and alternative designs will, of course, become apparent to those skilled in the art in light of the foregoing teachings without departing from the scope of the invention. The scope of the invention is indicated by the following claims rather than by the foregoing description. All changes and variations that fall within the meaning and range of equivalency of the claims are to be embraced within their scope.

What is claimed is:

1. A headband for use in a headgear support, comprising:

a first end section comprising a plurality of spaced connectors; and a second end section comprising a fastener attached adjacent the end thereof, the fastener comprising a connecting member comprising a longitudinally extending section that is connected at a first longitudinal end thereof to the fastener and connected at a second longitudinal end thereof to the fastener, the longitudinally extending section having at least one cooperating connector attached thereto, the longitudinally extending section biasing the cooperating connector in an engagement position with at least one of the plurality of connectors of the first end section to hold the headband in a selected loop configuration, the fastener further comprising at least a first flexible release member, the first flexible release member being movable to a release position upon application of a force to the first release member in which the first release member abuts the longitudinally extending section of the connecting member at a position intermediate between the first longitudinal end and the second longitudinal end of the longitudinally extending section to cause the longitudinally extending section of the connecting member to flex to a disengage position in which the cooperating connector is disengaged from the at least one of the plurality of connectors of the first end section to enable increasing the size of the loop of the headband.

2. The headband of claim 1 wherein the plurality of connectors on the first end section are slots.

3. The headband of claim 2 wherein the at least one cooperating connector is a projection.

4. The headband of claim 3 wherein more than one projection is attached to the longitudinally extending section of the connecting member.

5. The headband of claim 4 wherein at least one projection is attached to the longitudinally extending section on a first longitudinal side of the position at which the first release member abuts the longitudinally extending section at least one other projection is attached to the longitudinally extending section on a second longitudinal side of the position at which the first release member abuts the longitudinally extending section, the second side being opposite the first side.

6. The headband of claim 3 wherein each of the projections comprises a first surface which is angled to facilitate sliding of the projections over the slots of the first end section when the first end section and the second end section are moved relative to each other to decrease the size of the loop of the headband and a second surface that is angled to abut one of the slots of the first end section when in the engagement position and to provide resistance to movement of first end section and second end section relative to each other in a direction to increase the size of the loop of the headband.

7. The headband of claim 1 wherein a generally lateral force is applied to the first release member to place the first release member in the release position.

8. The headband of claim 7 wherein the first release member comprises a sloped surface which abuts the longitudinally extending section of the connecting member.

9. The headband of claim 1 further comprising a second flexible release member, the second release member being movable to a release position upon application of a force to the second release member in which the second release member abuts the longitudinally extending section of the connecting member to cause the longitudinally extending section of the connecting member to flex to the disengage position, the first release member being positioned on one lateral side of the fastener, the second release member being positioned on the other side of the fastener.

10. The headband of claim 1 wherein the fastener is formed monolithically from a polymeric material.

11. The headband of claim 1 wherein the headband is formed monolithically from a polymeric material.

12. A headband for use in a headgear support, comprising: a first end section comprising a plurality of spaced slots; and a second end section comprising a fastener attached adjacent the end thereof, the fastener comprising a flexible connecting member comprising a longitudinally extending section that is connected at a first longitudinal end thereof to the fastener and connected at a second longitudinal end thereof to the fastener, the longitudinally extending section having at least one cooperating connector attached thereto and biased by the longitudinally extending section in an engagement position with at least one of the plurality of slots of the first end section to hold the headband in a selected loop configuration, the longitudinally extending section being movable to a disengage position upon application of a generally lateral force to the fastener to cause the cooperating connector to disengage from the at least one of the plurality of slots of the first end section to enable increasing the size of the loop of the headband.

13. The headband of claim 12 wherein the at least one cooperating connector is a projection.

14. The headband of claim 13 wherein the projection comprises a first surface which is angled to facilitate sliding of the projections over the slots of the first end section when the first end section and the second end section are moved relative to each other to decrease the size of the loop of the headband and a second surface that is angled to abut one of the slots of the first end section when in the engagement position and to provide resistance to movement of first end section and second end section relative to each other in a direction to increase the size of the loop of the headband when in the engagement position.

15. The headband of claim 13 wherein the fastener further comprises at least a first flexible release member, the first flexible release member being movable to a release position upon application of a generally lateral force to the first release member in which the first release member abuts the longitudinally extending section to cause the longitudinally extending section to flex to the disengage position.

16. The headband of claim 15 further comprising a second flexible release member, the second release member being movable to a release position upon application of a generally lateral force to the second release member in which the second release member abuts the longitudinally extending section to cause the longitudinally extending section to flex to the disengage position, the first release member being positioned on one lateral side of the fastener, the second release member being positioned on the other side of the fastener.

17. The headband of claim 16 wherein generally lateral force is applied directly to the longitudinally extending section to cause the longitudinally extending section to move to the disengage position.

18. A headband for use in a headgear support, comprising: a first end section comprising a plurality of spaced slots; and a second end section comprising a fastener attached adjacent the end thereof, the fastener comprising a flexible connecting member comprising a longitudinally extending section that is connected at a first longitudinal end thereof to the fastener and connected at a second longitudinal end thereof to the fastener, the longitudinally extending section having at least one projection attached thereto and biased by the longitudinally extending section in an engagement position with one of the plurality of slots of the first end section to define a selected loop configuration of the headband, the fastener further comprising a first flexible release member on a first lateral side of the fastener, the first flexible release member being movable to a release position upon application of a force to the first release member in which the first release member abuts the longitudinally extending section at a position intermediate between the first longitudinal end and the second longitudinal end of the longitudinally extending section to cause the longitudinally extending section of the connecting member to flex to a disengage position in which the projection is disengaged from the at least one of the plurality of connectors of the first end section to enable increasing the size of the loop of the headband, the fastener further comprising a second flexible release member on a second lateral side of the fastener, the second release member being movable to a release position upon application of a force to the second release member in which the second release member abuts the longitudinally extending section to cause the longitudinally extending section of the connecting member to flex to the disengage position.

19. The headband of claim 18 wherein the first release member includes a sloped surface to abut the longitudinally extending section and the second release member includes a sloped surface to abut the longitudinally extending section.

20. The headband of claim 18 wherein the projection comprises a first surface which is angled to facilitate sliding of the projections over the slots of the first end section when the first end section and the second end section are moved relative to each other to decrease the size of the loop of the headband and a second surface that is angled to abut one of the slots of the first end section when in the engagement position and to provide resistance to movement of first end section and second end section relative to each other in a direction to increase the size of the loop of the headband.

21. The headband of claim 18 wherein more than one projection is attached to the longitudinally extending section, each of the projections being biased by the longitudinally extending section in an engagement position with one of the plurality of slots of the first end section.

22. The headband of claim 21 wherein each of the projections comprises a first surface which is angled to facilitate sliding of the projections over the slots of the first end section when the first end section and the second end section are moved relative to each other to decrease the size of the loop of the headband and a second surface that is angled to abut one of the slots of the first end section when in the engagement position and to provide resistance to movement of first end section and second end section relative to each other in a direction to increase the size of the loop of the headband.

23. The headband of claim 18 wherein a generally lateral force is applied to the first release member and second release member to cause the longitudinally extending section to flex to the disengage position.

* * * * *